United States Patent [19]

Auclair et al.

[11] Patent Number: 4,805,908

[45] Date of Patent: Feb. 21, 1989

[54] BOX FOR SHAKING DICE

[76] Inventors: Normand M. Auclair, 79, Perreault, Beloeil/Quebec, Canada, J3G 1X4; André J. Gladu, 40, St. Charles, St-Hilaire/Quebec, Canada, J3H 2Z8

[21] Appl. No.: 137,184

[22] Filed: Dec. 23, 1987

[30] Foreign Application Priority Data

Jan. 19, 1987 [GB] United Kingdom ..... 8701122

[51] Int. Cl.[4] ..... A63F 9/04

[52] U.S. Cl. ..... 273/145 C

[58] Field of Search ..... 273/145 R, 145 A, 145 C, 273/145 CA, 145 D, 145 E

[56] References Cited

U.S. PATENT DOCUMENTS

| | | | |
|---|---|---|---|
| 954,070 | 4/1910 | Zschau | 273/145 C |
| 2,296,001 | 9/1942 | Slattery | 273/145 C |
| 2,724,595 | 11/1955 | Amann | 273/145 A |
| 4,095,796 | 6/1978 | Monson | 273/145 C |

*Primary Examiner*—Anton O. Oechsle

*Attorney, Agent, or Firm*—Roland L. Morneau

[57] ABSTRACT

A dice shaker having a hinged cover provided on its lowered surface with an L-shaped partition which delimites an enclosed space when the lid is closed. The cross-section of the space corresponds to the cross-section of a die in order to limit or hinder the rotation of the dice located inside that space.

5 Claims, 2 Drawing Sheets

BOX FOR SHAKING DICE

BACKGROUND OF THE INVENTION

1. Field of the invention:

The present invention is directed to a box for shaking dice and more particularly to a such a box forming an inner chamber for immobilizing a row of dice when closing a single cover.

2. Prior Art:

U.S. Pat. No. 2,724,595 discloses a die box for shaking dice which has a lid and a transparent hinged partition for retaining the dice over the whole surface of the bottom. The partition is distinct from the cover of the box.

U.S. Pat. No. 4,095,796 is directed to a die shaker provided with a display chamber distinct from the mixing chamber and a slot for allowing the transfer of dice. A panel is slidably mounted to cover the slot.

SUMMARY OF THE INVENTION

The dice box according to the invention has a flat bottom and a flat side adjacent the bottom. The flat side and bottom are delimited sideways by two lateral walls. The lid which closes the box is provided with an L-shaped member secured to and inside the lid to delimit a space between the bottom, the side and the two lateral walls. The cross-section of the space corresponds to the one of a row of dices for hindering their rotation. The lid is preferably hinged to the flat side and the L-shaped member is disposed parallel to the flat side.

DETAILED DESCRIPTION OF THE INVENTION

Figure 1:
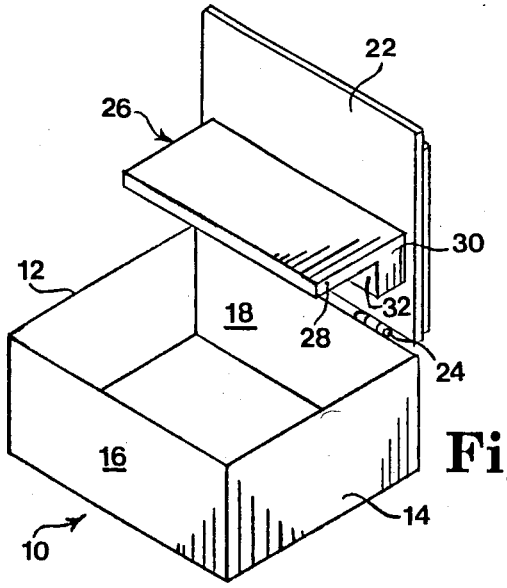
FIG. 1 is a perspective view of a die shaker according to one embodiment of the invention.
Figure 2:
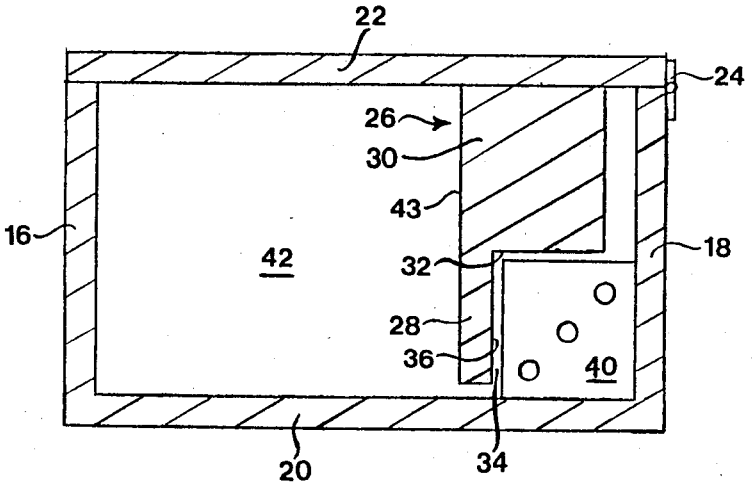
FIG. 2 is a cross-section of the shaker shown in FIG. 1 with the lid closed over a die.

The embodiment illustrated in FIGS. 1 and 2 includes a parallelepipedic box 10 made of two lateral walls 12 and 14, a front and rear walls 16 and 18, a bottom face 20 and a lid 22. The lid 22 is connected to the rear wall 18 by hinges 24 (one not shown).

An L-shaped partition 26 is secured to the inside surface of the lid 22. The partition 26, when the lid 22 is closed, has a vertical side 28 and a horizontal side 30. The side 30 is thick so as to lower the roof of the box within the enclosed space surrounded by the L-shaped partition 26. The enclosed space 34 which is delimited by the horizontal surface 32 and the vertical surface 36 of the L-shaped partition is intended to receive dice and maintain them in a position so as to prevent their rotation.

As shown in FIG. 2, the die 40 rests against the flat rear wall 18 over the flat bottom surface 20 and is maintained in that position by the L-shaped partition 26. The horizontal side 32 and the vertical side 36 of the L-shaped partition 26 do not have to contact or abut against the surface of the die 40 but it only has to be in close proximity with them so as to prevent the rotation of the dice enclosed in the space 34. The gap between the die and the horizontal surface 32 is particularly useful when the box as a hinged lid. When the dice are not pushed in closed proximity with the rear wall 18, the closing of the lid causes the vertical side 28 to push them closer towards the rear wall 18.

In operation, the dice are placed in the chamber 42 of the box, that is between the front wall 16 and the front side 43 of the L-shaped partition 26. Once the dice are shaken at will, the box is opened and any combination of dice which the player desires to retain is pushed by the fingers towards the rear wall 18. The lid is then closed and dice of that combination are retained unchanged in the space 34. The remaining dice in chamber 42 which needs to be mixed again are shaken in the closed box 10 without changing the combination of one or more dice which are trapped in the space 34. When the lid 22 is reopened, it is easy to observe all the dice at the same time and to reach a conclusion on any new winning combination.

As it may be easily observed, the present dice shaker has a very simple construction and allows, by two simple operations to trap one or more dice. It consists of pushing some dice against the rear wall 18 and to close the lid 22. It become possible to shake part of the dice and refrain others from rotating.

Figure 3:
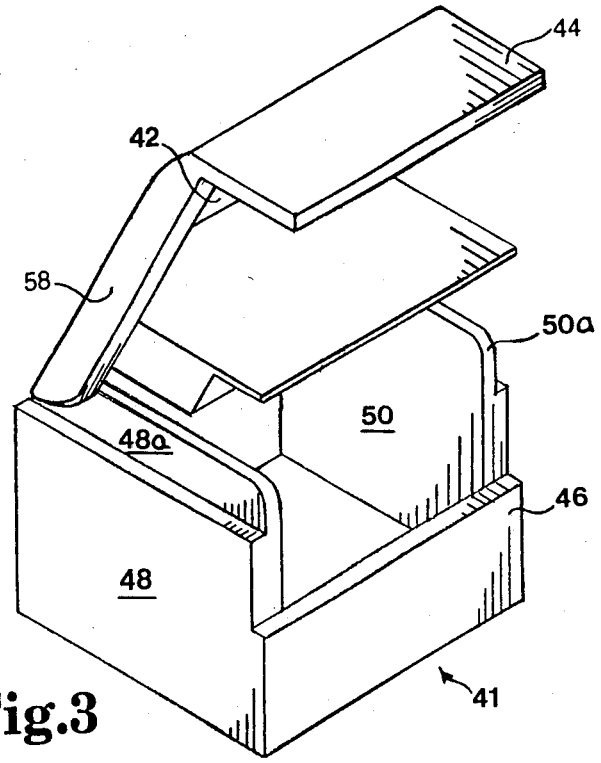
FIG. 3 is a perspective view of another embodiment of the die shaker.

Another embodiment is shown in FIG. 3 wherein the dice shaker 41 has a lid 42 provided with a front ledge 44. The ledge 44 allows to close the shaker 41 even though the front wall 46 is lower than the sidewalls 48 and 50. This arrangement is favoured to allow the player who is shaking the dice to open the box and observe the dice with a more exclusive view of the inside of the box than the players on his sides which have their views hindered by the sidewalls 48 and 50. It is also possible to further raise the height of the sidewalls by the arrangement illustrated in FIG. 3. The lid 42 is provided with lateral ledges 58 (one not shown) which ride adjacent the top of the lateral walls 48a and 50a.

Figure 4:
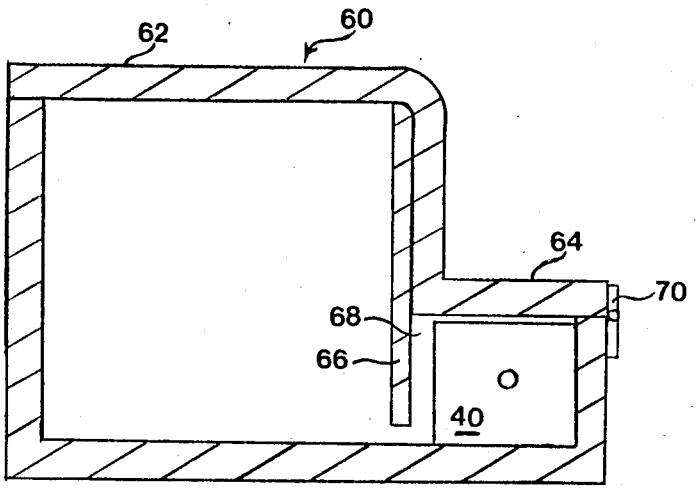
FIG. 4 is a cross-section of another embodiment of the invention with the lid closed over a die.

Another embodiment of the invention is illustrated in FIG. 4 wherein the lid 60 forms part of the L-shaped member described in FIG. 1. The lid 60 has two levels 62 and 64, the level 64 being lower than the level 62 and forming the horizontal side of the enclosed space 68. A partition 66 extends downwardly at the intersection of the two levels 62 and 64 and provides the vertical side of the enclosed space 68. In the embodiment shown in FIG. 4, as in the embodiment shown in FIGS. 1 and 2, the enclosed space 68 can be slightly larger than the dice 40 as long as the sides 64 and 66 hinder the rotation of the dice 40. The lid 60 moves up and down around the axle provided by the hinge 70.

Although, the enclosed spaces have been described as being adjacent the rear wall of the die shaker, that is, the wall adjacent the hinge, it would be obvious that the L-shaped member could be located against the front wall 16. It is obvious that this location is not preferred because the lower edge of the vertical side 28 would have a tendency to hit the dices when lowered, if the dice are not brought sufficiently close to the front wall 16. To overcome this disadvantage, the enclosed space 36 would have to be made larger which is not necessarily an advantage for the present invention.

The present invention has also been described with a hinged lid but hinges such as 24 and 70 are not essential characteristics. The lids such as 22 and 60 could be lowered somewhat vertically by hand without the use of a hinge. However, a hinged lid facilitate the operation of the box and determines the orientation of the lid relative to the sidewalls.

We claim:

1. A box for shaking dice comprising an enclosed casing having a flat bottom, a transversal wall adjacent said bottom, two lateral walls for delimiting said transversal wall adjacent said bottom, a lid for closing said casing, a L-shaped partition fixed to and under said lid, the said L-shaped partition being located and oriented on said lid for delimiting a space between said partition, said flat bottom and said transversal wall when said lid is closed, the cross-section of said space substantially corresponding to the cross-section of the dice to be shaken so as to hinder the rotation of the dice.

2. A box as recited in claim 1, wherein the said L-shaped partition forms a substantially square cross-section with said bottom and said flat side when the lid is closed.

3. A box for shaking dice comprising an enclosed casing having a flat bottom, a transversal wall adjacent said bottom, two lateral walls for delimiting said transversal wall adjacent said bottom, a lid for closing said casing, said lid having a recess inside said casing, an upright member extending from said lid inside said casing adjacent said recess, the said upright member delimiting a space with said flat bottom and said transversal wall and said recess corresponding substantially to the cross-section of the dice to be shaken so as to hinder their rotation.

4. A box as recited in claim 1 or 3, wherein the lid is hinged to the transversal wall.

5. A box as recited in claim 1 3, wherein the box has a parallelepipedic shape, the said box having a side opposite said transversal wall lower than the said lateral walls.

* * * * *